US006796681B2

(12) United States Patent
Fan

(10) Patent No.: US 6,796,681 B2
(45) Date of Patent: Sep. 28, 2004

(54) LIGHT STRING WITH LIGHT BULBS ALTERNATELY CONNECTED IN SERIES SO AS TO FORM TWO CIRCUITS

(76) Inventor: Ben Fan, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 0 days.

(21) Appl. No.: 10/314,524

(22) Filed: Dec. 9, 2002

(65) Prior Publication Data

US 2004/0109311 A1 Jun. 10, 2004

(51) Int. Cl.[7] ..... F21S 4/00

(52) U.S. Cl. ..... 362/249; 362/252; 362/236; 362/800

(58) Field of Search ..... 362/238, 252, 362/249, 240, 246, 270, 62, 682, 683, 686, 692, 695, 668, 669, 236; 445/22; 439/682, 683, 686, 692, 695, 668, 669

(56) References Cited

U.S. PATENT DOCUMENTS 6,244,726 B1 * 6/2001 Fan Wong et al. ..... 362/240
6,497,496 B2 * 12/2002 Wang ..... 362/249
6,517,219 B1 * 2/2003 Chen ..... 362/349
6,604,841 B2 * 8/2003 Liu ..... 362/252

* cited by examiner

*Primary Examiner*—Thomas M. Sember
*Assistant Examiner*—Hargobind S Sawhney
(74) *Attorney, Agent, or Firm*—William E. Pelton, Esq.

(57) ABSTRACT

A light string includes light bulbs, an oval core having two power cord holes respectively defined to receive therein two secondary power cords, wire holes each defined to receive one of two wires extending from two adjacent light bulbs, apertures each defined between two wire holes, light bulb holes radially defined in the oval core to respectively receive therein one of the light bulbs and a circular cutout defined in a central portion of the oval core to allow extension of connection wires, each connection wire being connected between two wires from two alternately located light bulbs in the oval core and intersected with one another in one of the apertures, and a protrusion integrally formed on a side of the oval core and having a primary power cord hole defined to receive therein a primary power cord.

6 Claims, 3 Drawing Sheets

LIGHT STRING WITH LIGHT BULBS ALTERNATELY CONNECTED IN SERIES SO AS TO FORM TWO CIRCUITS

BACKGROUND OF THE INVENTION

1. Field of the Invention

The present invention relates to a light string, and more particularly to a light string with light bulbs alternately connected in series so as to form two different circuits. The light string is thus able to present a glamorous and decorative atmosphere.

2. Description of Related Art

A conventional light string has a structure shown in U.S. Pat. No. 5,934,792 ('792), which has a core (114), a cladding (112) attached around the core, multiple light bulbs securely received in the core (114) and two wires (210,212) connected to the light bulbs for connection with a power supply. It is to be noted from the attached drawings of the '792 patent that the light bulbs lay in the core (114) such that when the light string is bent, which is frequently required especially when the light string is placed on a tree to decorate the tree, the light bulbs are easily broken. Another conventional light string is shown in FIG. 4, wherein there are three holes (41,42,43) respectively defined in two mutually orthogonal imaginary planes for receiving therein wires (not shown) such that when the light string of this kind is in use, the light string can not be bent. Still another conventional light string is shown in the cross sectional view in a radius direction of the core (50) of FIG. 5, and the cross sectional view in a longitudinal direction of the core (50) in FIG. 5, which is shown in FIG. 6. The core (50) is elliptical in shape and has primary holes (51) defined to receive therein light bulbs (52) and three secondary holes (53,54,55) for receiving therein wires (56). The primary hole (51) is close to a side of the elliptical core (50) which results in when the primary hole (51) is defined by an appropriate device, the core (50) is easily broken. Further, the wires received in the two outermost secondary holes (51,53) protrude out of the periphery of the core (50), which spoils the beauty of the appearance.

To overcome the shortcomings, the present invention tends to provide an improved light string to mitigate and obviate the aforementioned problems.

SUMMARY OF THE INVENTION

The primary objective of the present invention is to provide an improved light string having a circular cutout defined to receive therein a power cord, a connection wire hole defined in a protrusion of a core, wire holes defined to receive therein a joint of two connection wires and a groove defined in an outer periphery of the core to receive therein a portion of the wires and the connection wire.

Another objective of the present invention is that due to the formation of the circular cutout, the cost for making the light string is reduced.

Another objective of the present invention is that the light string is durable because the light bulb hole is defined in a center of the core so that when defining the light bulb holes, the core is able to be maintained intact.

Other objects, advantages and novel features of the invention will become more apparent from the following detailed description when taken in conjunction with the accompanying drawings.

DETAILED DESCRIPTION OF THE PREFERRED EMBODIMENT

Figure 1:
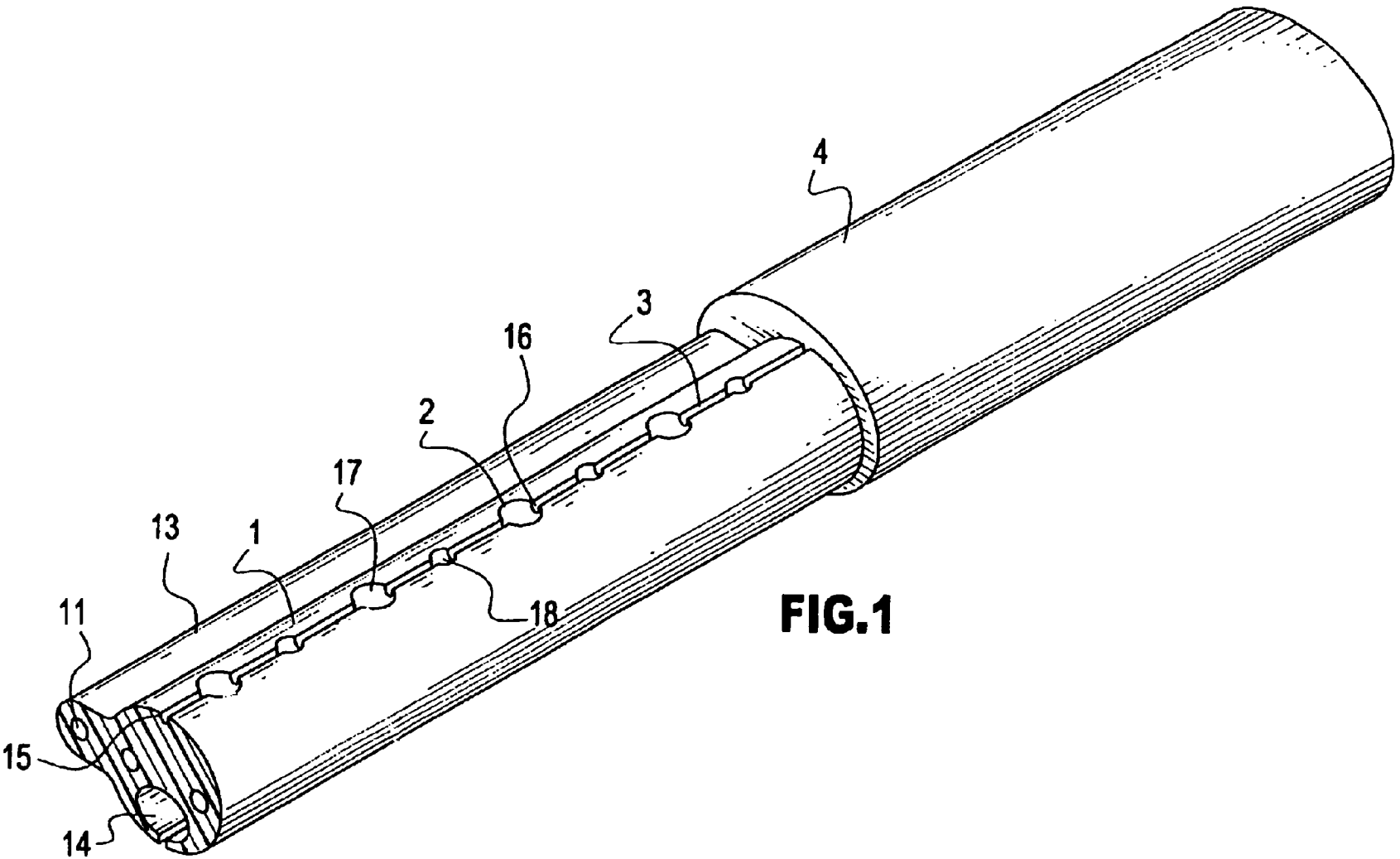
FIG. 1 is a perspective view of the light string of the present invention.
Figure 2:
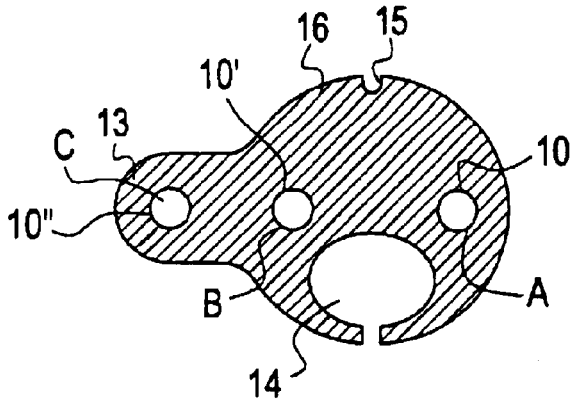
FIG. 2 is a cross sectional view of the core of the light string of the present invention.
Figure 5:
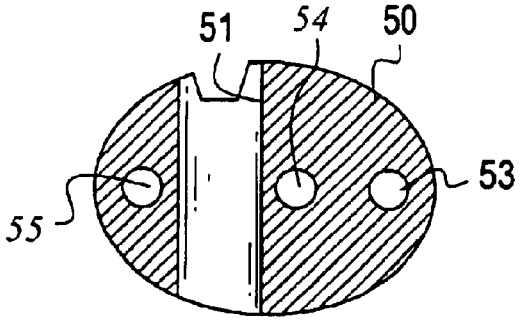
FIG.5 PRIOR ART
FIG. 5 is a cross sectional view showing still another conventional core.
Figure 4:
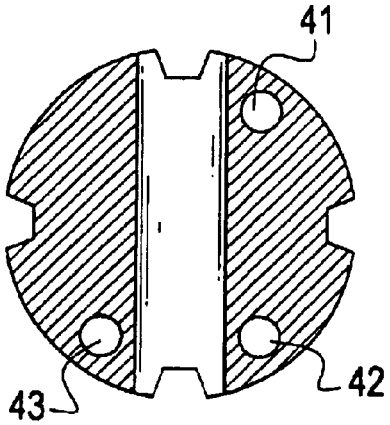
FIG.4 PRIOR ART
FIG. 4 is a cross sectional view showing a structure of a conventional core of a light string.
Figure 3:
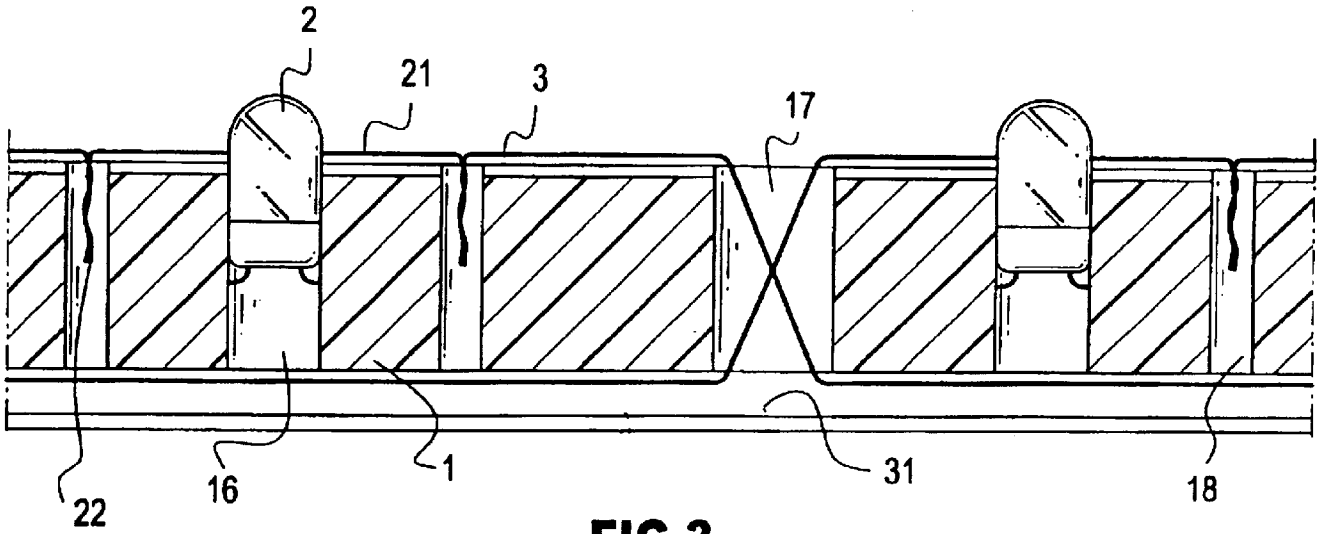
FIG. 3 is a schematic side plan view with partial in section, wherein the light bulbs are received in the light bulb holes and the wires are connected to the connection wires in apertures.
Figure 6:
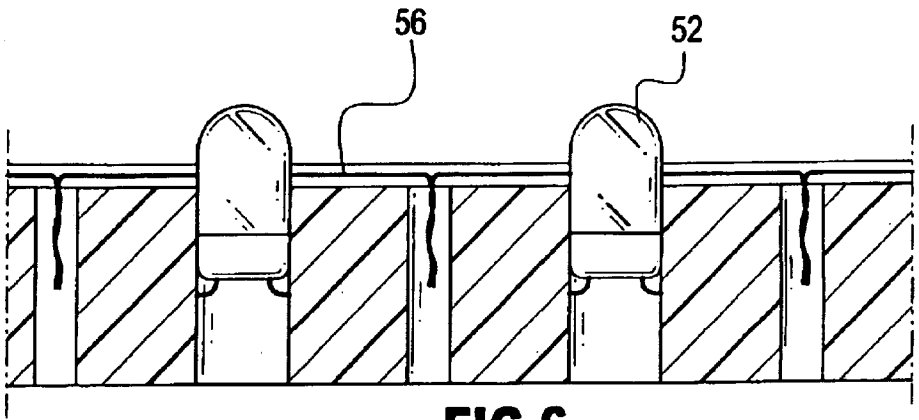
FIG.6 PRIOR ART
FIG. 6 is a cross sectional view showing the core in FIG. 5 from another angle.

With reference to FIGS. 1, 2 and 3, a light string in accordance with the present invention has an oval core (1), light bulbs (2), a connection wire (3) and a cover (4).

The oval core (1) is made of a thermoplastic material and has power cord holes (10, 10') respectively to receive therein two secondary power cords (A,B), wire holes (18) each defined to receive one of two wires (21) from two adjacent light bulbs (2) and apertures (17) each defined between two wire holes (18). The oval core (1) has a protrusion (13) securely formed with the oval core (1) and having a primary power cord hole (10") defined to receive therein a primary power cord (C). The oval core (1) further has a circular cutout (14) defined in a central portion of the oval core (1) to receive therein the connection wire (3), and light bulb holes (16) radially defined in the oval core (1) to respectively receive therein one of the light bulbs (2).

During assembly of the light string of the present invention, each of the light bulbs (2) is respectively received in a corresponding one of the light bulb holes (16). Because each light bulb (2) has two wires (21) extending out from the light bulb (2), each of the wires (21) is respectively connected to the secondary power cords (A,B). As better seen from FIG. 3, the first (from left to right of the drawing) light bulb (2) has a wire (21) extending to the right to connect with a connection wire (3). After the wire (21) is connected to the connection wire (3) in the wire hole (18) to form a joint (22), the connection wire (3) extends downward through the aperture (17) and into the circular cutout (14). Then the connection wire (3) extends upward through another aperture (17) to form another joint (22) in another wire hole (18) after passing through a light bulb (2) next to the first light bulb (2). That is, the first light bulb (2) is connected to the third light bulb (2), the fifth light bulb (2), the seventh light bulb (2), etc. Meanwhile, the second, the fourth, the sixth, the eighth light bulbs (2), etc. are connected in series by means of the connection wire (3).

Thereafter, the light bulbs (2) with odd numbers, for example, are connected to the first secondary power cord (A) and the light bulbs (2) with even numbers, for example, are connected to the second secondary power cord (B). After the foregoing assembly is finished, the first secondary power cord (A) and the second secondary power cord (B) are respectively connected to the primary power cord (c) to provide electricity to the light bulbs (2). From the arrangement of the present invention, two connection wires (3) intersect each other in the aperture (17). However, the intersection between the two connection wires (3) does not cause an electrical short. The technique is well known in the art, thus is not addressed in the description.

It is concluded from the foregoing description that the present invention is able to control the even-sequenced light bulbs and the odd-sequenced light bulbs to blink in totally different patterns so as to create an attractive appearance.

Furthermore, because of the formation of the circular cutout (14), the material used to make the core (1) is reduced. The wires (21) and the connection wires (3) are partially positioned in the groove (15) and after passing through the aperture (17), the connection wire (3) extends in the circular cutout (14). Therefore, after the cover (4) is formed outside the oval core (1), the wires (21), the connection wires (3) and the light bulbs (2) are all covered by the cover (4). Because the light bulbs (2) are located in the radial direction of the light string, the lighting effect is increased.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light string comprising:

light bulbs;

an oval core having two power cord holes respectively defined to receive therein two secondary power cords, wire holes each defined to receive one of two wires extending from two adjacent light bulbs, apertures each defined between two wire holes, light bulb holes radially defined in the oval core to respectively receive therein one of the light bulbs and a circular cutout defined in a central portion of the oval core to allow extension of connection wires, each connection wire being connected between two wires from two alternately located light bulbs in the oval core and intersected with one another in one of the apertures, and a protrusion integrally formed on a side of the oval core and having a primary power cord hole defined to receive therein a primary power cord, whereby light bulbs of an even-numbered sequence are connected in series via a portion of the connection wires and one connection wire is connected to the primary power cord, light bulbs of an odd-numbered sequence are connected in series via another portion of the connection wires and one connection wire of this another portion is connected to the primary power cord.

2. The light string as claimed in claim 1 further comprising a groove defined in an outer periphery of the oval core to receive therein the wires and the connection wires.

3. The light string as claimed in claim 2, wherein one of the two wires from a light bulb is connected to one of the connection wires in one of the wire holes to form a joint.

4. The light string as claimed in claim 3, wherein each of the apertures is defined between two connection wire holes.

5. The light string as claimed in claim 4, wherein two of the connection wire holes and one of the apertures are defined between two adjacent light bulb holes.

6. The light string as claimed in claim 1, wherein each of the apertures is defined between two connection wire holes.

* * * * *